US005839239A

United States Patent [19]

Jang

[11] Patent Number: 5,839,239

[45] Date of Patent: Nov. 24, 1998

[54] APPARATUS AND METHOD FOR BUILDING CONSTRUCTION

[76] Inventor: Byung K. Jang, 149 Washington Rd., Glenview, Ill. 60025

[21] Appl. No.: 831,164

[22] Filed: Apr. 1, 1997

Related U.S. Application Data

[60] Provisional application No. 60/014,830 Apr. 4, 1996.

[51] Int. Cl.[6] ..... E04H 12/34; B66C 23/34

[52] U.S. Cl. ..... 52/123.1; 52/122.1; 52/125.1; 52/126.6; 52/749.1; 254/93 R

[58] Field of Search ..... 52/749.1, 123.1, 52/125.1, 126.5, 126.6, 122.1, 125.6; 254/93 R

[56] References Cited

U.S. PATENT DOCUMENTS

| | | | |
|---|---|---|---|
| 2,217,115 | 10/1940 | Hermodsson . | |
| 3,327,997 | 6/1967 | Zenke | 52/125.1 X |
| 3,552,080 | 1/1971 | Gretchenliev et al. | 52/125.1 X |
| 3,579,935 | 5/1971 | Regan | 52/125.1 |
| 3,713,265 | 1/1973 | Wysocki et al. | 52/125.1 X |
| 3,722,169 | 3/1973 | Boehmig | 52/125.1 X |
| 3,822,522 | 7/1974 | Termohlen et al. | 52/125.2 X |
| 3,921,362 | 11/1975 | Cortina | 52/125.1 X |
| 3,974,618 | 8/1976 | Cortina | 52/125.1 X |
| 4,251,974 | 2/1981 | Vanderklaauw | 52/125.1 X |
| 4,980,999 | 1/1991 | Terenzoni . | |
| 5,305,574 | 4/1994 | Fedock et al. . | |

FOREIGN PATENT DOCUMENTS

| | | | |
|---|---|---|---|
| 1 903 550 | 8/1969 | Bulgaria | 52/125.1 |
| 04357227A | 10/1992 | Japan . | |
| 06042186A | 2/1994 | Japan . | |
| 06073886A | 3/1994 | Japan . | |
| 06212806A | 8/1994 | Japan . | |
| 1043101 | 9/1966 | United Kingdom . | |

*Primary Examiner*—Christopher Kent
*Assistant Examiner*—Yvonne Horton-Richardson
*Attorney, Agent, or Firm*—Richard C. Litman

[57] ABSTRACT

Two methods of constructing either a metal or wooden framed multi-story building and corresponding apparatus utilized in the construction. Building includes erecting roof frame beams and subsequent floor levels. For a metal framed building, motorized lifting devices are positioned on specific metal bars. Each metal floor frame has corresponding metal lifting bars. Metal post beams are supported by metal assembly brackets of several lengths, including a spacer block during the repositioning of the motorized lifting devices for the next floor level. The metal corner post beams and the motorized lifting device can further be supported during the lifting procedure by a collar and bracket system. The horizontal level of each floor is controlled by a central control system including lasers, laser sensors and a computer. A second embodiment is directed to the building of wood houses to utilize cantilevered metal lifting bar assemblies supported by lifting devices. The lifting bar assemblies have adjustable framing spaces on top for forming one to three joists in a space. The corner and intermediate outside posts can be formed to have a predetermined set of holes for fastening a glass facade for the building. The construction can be aided by the use of a combination building support and work area assembly placed in the ground on the outside of the building.

20 Claims, 17 Drawing Sheets

APPARATUS AND METHOD FOR BUILDING CONSTRUCTION

CROSS-REFERENCE TO RELATED APPLICATION

This application claims the benefit of U.S. Provisional patent application Ser. No. 60/014,830, filed Apr. 4, 1996.

BACKGROUND OF THE INVENTION

1. Field of the Invention

The present invention relates to apparatus for and a method of constructing a multi-story building to ensure the accurate horizontal alignment of each floor. More specifically, the invention is an apparatus for and a method of constructing a multi-story building by successively constructing an entire beamed floor frame (steel or wood) of a building and raising the completed floor frame to an accurate horizontal height by synchronized and motorized lifting devices, so that the next floor frame can be constructed beneath the first floor frame by monitoring the horizontal alignment by a laser means levelling system. The apparatus includes the employment of metal planks having the same shape for a steel beam building. These planks are positioned as lifting beams and base support beams for the motorized lifting devices into various configurations such as squares for inside post beams, V's for outside side wall post beams and single planks for corner post beams. An innovative inclusion is a spacer block unit confined within an elongated assembling bracket for each post on a floor frame when the motorized lifting devices are being removed and positioned under the next floor framework. A ratcheting extension attached to the end of a floor beam being raised is employed as a fail-safe device in the event the lifting devices malfunction. The ratchet's lip cooperates with the teeth on one flange of the right-angled assembling bracket. Another innovation is the provision of stabilizing the lifting devices with a base bracket attached diagonally to intersecting floor beams and a collar extension attached to the post beam positioned at the intersection. Yet another innovation for glass facade buildings would be corner supports and intermediate posts between floors having a specific configuration with a predetermined pattern of holes for later attachment of the glass panels. In conjunction with all the embodiments and innovations, an outside building support and working area structure extending up to at least one-half the projected height of the building can be implanted in the ground. The building support and working area structure is maintained against the building frame by a horizontal side support bar attached to the building frame on one entire side only at its ends. The building support and working area structure can then be readily moved along the one side of the building frame.

An embodiment directed to the building of wooden beamed houses by a modified bar assembly is contemplated. The jacking system is employed with a cantilevered bar assembly. The hollow metal bar assembly provides for the installation of various sized joists by utilizing adjustable frames. The metal bar assembly extends the length of the house by connected sections. A laser control system is still utilized to monitor the horizontal leveling of the floor structure. However, there is no need for the ratcheting, the right-angled assembling bracket devices, the spacer bars, and the metal planks utilized in the first embodiment for the construction of steel beam framed buildings.

2. Description of the Prior Art

Methods of constructing multi-story buildings by starting with the roof are known in the prior art and will be reviewed in the order of their perceived relevance.

Japanese Application No. 04357227A published on Dec. 10, 1992, for Sakae Kawahara describes a method of building and connecting column members. The highest floor 16 is assembled on the ground 5 and then lifted by four hydraulic cylinders 9 positioned at the corners. The lower levels are constructed one by one by adding casings for support columns at each corner. The cylindrical casings for each floor are connected by inner guide linkages (FIGS. 7A and 7B) to the next set of casings as shown in FIG. 3. No disclosure of any horizontal monitoring of each floor is present.

Japanese Application No. 06212806A published on Aug. 2, 1994, for Takumi Fujii describes a method of constructing a building with jacks and accurately positioning the plane of a driving floor and the columns. This method includes installing jack devices on the top of each column to act as a correction means for leveling a driving plane. Two measuring instruments 3 are positioned at ground level and project laser beams up to the driving floor 1 as a reference during elevation. The jack assembly 5 consists of four jacks supported by two end assemblies, each end assembly having two diametrically opposed column guides having two roller guides each, and two diametrically opposed rocking beams. The laser device system as disclosed is hereby incorporated by reference.

U.S. Pat. No. 2,217,115 issued on Oct. 8, 1940, to Carl H. Hermodsson describes a method of constructing a building wherein the roof of the building is constructed on mold frames over a foundation. The molds are filled with concrete, then the roof and mold frames can be raised from the foundation so that the frames can be filled with concrete to form the second level of the building. Inside and outside scaffoldings or platforms for the use of the workmen in forming the walls and the floors are used also as the lower wall of a mold for casting a floor. The process is repeated floor by floor until the building is completed. The roof and frames may be raised by a motorized gear rack and pinion system (FIGS. 1–3), jacking system (FIG. 4) or a pulley system (FIG. 5), which apparatuses are detachably carried by the roof. The difference resides in that Hermodsson describes each jacking system comprises a cylinder containing a piston and a piston rod connected permanently at various points on a floor along the walls. The piston rod of the jack apparently has a limited length and requires the frame and the roof to be further increased in height by perforated blocks which become a wall. Furthermore, this method requires half of the jacks to be adjusted in height at a time in increasing the height of the walls. This method creates stress in the floor because of the uneven lifting of the newly built floor.

U.S. Pat. No. 4,980,999 issued on Jan. 1, 1991, to Terenzoni describes a method and apparatus for raising a roof. The method uses at least two lifting towers and two lifting beams to lift a roof from a resting position. The lifting is accomplished by either lifting cylinders or a pulley system under a central electrical control unit. After the walls are constructed under the roof, the lifting towers can lower the roof to a resting position. There is no precise measuring means controlling the lifting operation.

U.S. Pat. No. 4,251,974 issued on Feb. 24, 1981, to Peter M. Vanderklaauw shows a jacking system for the control of lift-slab or lift-plate construction with permanent or removable columns. The system in FIG. 1 uses converging control wires at each corner of a slab connected to the top of each column which activate electric pumps via pulleys to raise the slab to the desired height. Sensors in FIG. 3 determine if the pumps are not raising a portion of the building at the same rate as the other pumps and pulleys. A sensor operates through a dancer pulley which senses a slack in the control wire and through a mechanical lever turns off the microswitch energizing that sensor. This column raising control system is a significantly different mechanism than the present invention.

United Kingdom Patent No. 1,043,101 published Sep. 21, 1966, for John R. T. Douglas describes a building construction method to form a concrete roof and concrete floors and lifting each layer with a system comprising two lifting rods having a cross-head 8 or a beam 12 at their threaded tops and two lifting devices 10 at their threaded bottoms. Around the base of the columns, floor slabs are poured and lifted by the power-operated lifting devices 10 (which include a rotatable square nut) to the desired resting position where the slab is secured to the column. The plurality of lifting motors are connected to a common hydraulic pump. There is no continuous monitoring means to ensure the horizontal alignment of the slabs.

U.S. Pat. No. 5,305,574 issued on Apr. 26, 1994, to Fedock et al. describes a method of erecting an absorber tower using trestles and jacks. The tower is made from segments of circular rings. A metal ring is welded together and then raised by a system of jacks climbing tracks positioned on a column of the trestle. A second ring is constructed below the first, at which time the first ring is welded to the second ring. The jack is then reset to raise both layers, so that the process can be repeated until the tower is complete. There is no continuous monitoring means to ensure the horizontal alignment of the rings.

Japanese Application No. 06042186A published on Feb. 15, 1994, for Susumu Tanaka describes a method of erecting a steel-framed dwelling house with vertical hexagonal posts 4 and I-beams 9 between posts. The method uses a set of hydraulic jacks 16, positioned on apertured climbing poles 15, wherein each jack set has two jacks with one jack inverted. The upper jack abuts a bracket holding four square pieces which aid in holding up the floor beam. A stroke adjusting jig 17 fits inside the climbing pole 15 to raise the upper floor I-beam assembly for the roof 11 or a floor, after the roof or floor has been constructed at near ground level. No horizontal monitoring of each level is disclosed.

Japanese Application No. 06073886A published on Mar. 15, 1994, for Shoji Otaki describes a method of constructing a building by using one-half the conventional number of step-jacks and eliminating step rods. The method begins by lifting a drive floor 1 up a stroke pillar 3 with a hydraulic jack 16 (consisting of two step-jacks 9, 10), and installing a modular pillar 4 having partial floor extensions (on both sides) beneath the jacked up stroke pillar. The next floor segments 19 are then attached to the modular pillar on both sides. The spacer element in this disclosure becomes a permanent part of the pillar and floor structure, whereas in the present invention the spacer element for a post beam is a temporary element. Furthermore, no disclosure of coordinating the jacking up process is seen.

None of the above inventions and patents, taken either singly or in combination, is seen to describe the instant invention as claimed.

SUMMARY OF THE INVENTION

The present invention provides at least two methods of constructing either a metal or wooden framed multi-story building and the corresponding apparatus utilized in the construction. The building is built at ground level by erecting the roof frame beams and subsequent floor levels. For a metal framed building, motorized lifting devices are positioned on equal-sized and shaped metal bars and lifts each metal floor frame with metal lifting bars of the same size and shape. The metal bars are elongated and have opposing ends formed at 45° to form squares around inside post beams, a V-shape for outside post beams, and across outside corners of the building frame. The metal post beams are supported by metal assembly brackets of several lengths including a spacer block during the repositioning of the motorized lifting devices for the next floor level. The metal corner post beams and the motorized lifting device can further be supported during the lifting procedure by a collar and bracket system. The horizontal level of each floor is controlled by a central control system including lasers, laser sensors and a computer. An additional structure for glass facade buildings includes corner posts having a specific structure with a predetermined pattern of holes for attachment of the glass panels. An external building support and working area which has its feet implanted in the ground and extends at least one-half the projected height of the building frame is contemplated. This structure is pinned against the frame by a building side-long side support member. A second embodiment is directed to the building of wood houses to utilize cantilevered metal lifting bar assemblies supported by lifting devices. The lifting bar assemblies have adjustable framing spaces on top for forming one to three joists in a space. Accordingly, it is a principal object of the invention to provide an improved apparatus and method of constructing a multiple story building by construction of the roof frame on or near ground level, then successively raising the completed framed levels so that new framed levels can be constructed below the higher levels.

It is an object of the invention to provide a method of constructing a building using motorized lifting devices which extend up to a height of a single floor of a building and are either extended higher or relocated for construction of the next floor frame.

It is a further object of the invention to provide a control system including laser sensors for a set of motorized lifting devices that will allow the heads of the lifting devices to be raised on a level plane, regardless of the varying load applied to each device.

Another object of the invention is to provide a temporary assembling bracket (including a solid spacer element) between metal post beams for the repositioning of the motorized lifting devices for the next metal floor structure.

Still another object of the invention is to provide a ratcheting system in conjunction with the temporary assembling bracket as a fail-safe device in the event a motorized lifting device fails in the construction of a metal beamed building.

Yet a further object of the invention is to provide a temporary stabilizing means for the lifting devices including a floor bracket and a post beam bracket for a metal beamed building.

Another object of the invention is to provide metal corner posts with a predetermined pattern of holes for attachment of a glass facade.

Still another object of the invention is to provide an external building support and working area with its feet implanted in the ground and extends at least one-half the height of the building, and which is further supported by a horizontal bar member which extends across one side of the building frame.

Yet another object of the invention is to provide another bar assembly for the construction of wooden framed houses.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a method and apparatus for constructing a building with either steel beams or wood joists. The method begins with the construction of the roof frame and the uppermost floor frame of the building at ground level, and subsequently raises the completed uppermost floor frame so that a new floor or ground level frame can be constructed below it until the ground floor level is completed. This method of construction makes it possible for the majority of the work to be performed at or near ground level. Since the work is completed in one centralized area, which is on the ground level around the structure, equipment and raw building materials can be conveniently located in an area in close proximity to where the construction is to take place. This method of construction reduces injuries that may occur from a person and/or equipment falling off of the partially framed building from an elevated height.

Figure 1:
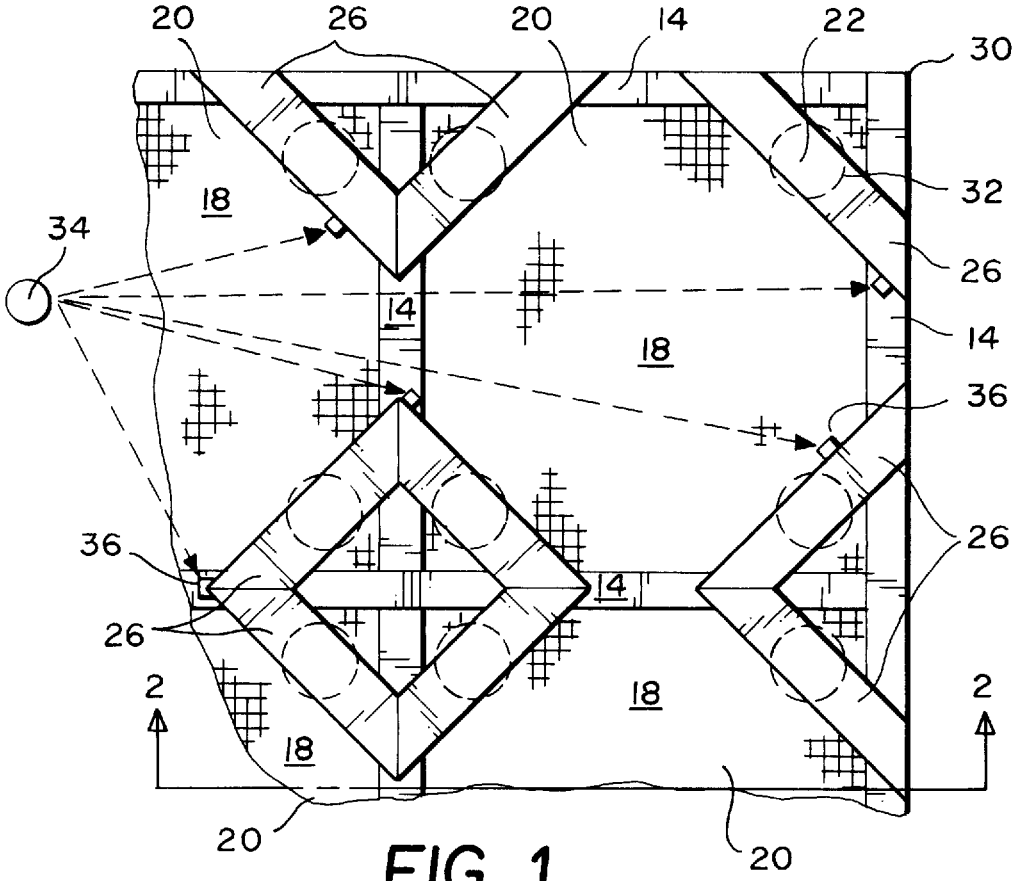
FIG. 1 is a partial top view of lifting bars positioned to form squares around an inside post beam, a V-shape for an outside wall post beam, and across an outside corner post beam with grating positioned beneath the bars. The locations of the hydraulic jack heads underneath the bars and through apertures in the grating are shown in dashed lines. A laser system is shown controlling the levels of the individual lifting devices by responding to the signals from the laser sensors placed on the lifting beams at strategic positions.
Figure 2:
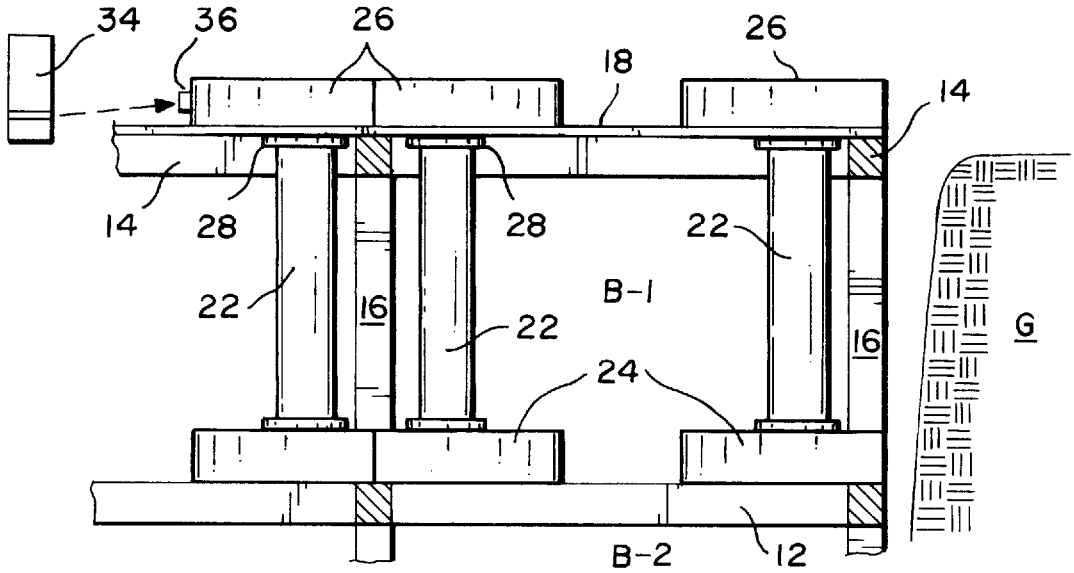
FIG. 2 is a front view of FIG. 1 along the section line 2—2 showing the beginning positions of the lifting devices positioned on support beams and below lifting beams, wherein two basement regions have been formed.

With reference to the first embodiment concerning steel beamed buildings, and in particular, FIGS. 1 and 2, the first step in the method of constructing a building structure 10 is to excavate the ground G and lay the foundation (not shown) and basement floor levels B-2 and B-1 (in the order recited) of the structure 10 from the basement floor beams 12 up to the first floor beams 14 and post beams 16, but not the final flooring for the first floor. A temporary working floor 18 is laid down for each section 20 to create a work surface to support a person and equipment while construction takes place. The temporary working floor 18 can be a metal grating having a mesh size of 1 to 2 in. and, optionally, wooden planks or panels can be laid down on top of the temporary working floor 18 for each section 20. A number of motorized lifting devices 22 are placed in the first basement level B-1 on support bars 24. These support bars 24 are identical in shape and size to the lifting bars 26 positioned above the heads 28 of the lifting devices 22. The opposite ends of the lifting/support bars are inclined at 45° as illustrated in FIG. 1 to form opposite sides of unequal lengths.

In the preferred embodiment, motorized hydraulic jacks are utilized as the lifting devices 22. However, a pneumatic jack can be utilized. These motorized lifting devices 22 are positioned in convenient locations beneath the roof beam frame 40 (FIG. 2), i.e., around each of the post beams 16 erected inside, next to the post beams 16 erected outside to straddle a T-intersection, and in each corner 30 of the floor beam structure. The motorized lifting device heads or jack heads 28 rest in the same horizontal plane as the first floor beams 14 or slightly above the temporary flooring. This temporary working floor 18 must have openings 32 through which the motorized lifting devices 22 may vertically travel.

The innovative feature in the lifting apparatus is the utilization of identically shaped and sized metal bars as lifting bars 26 and base support bars 24 for the lifting devices 22. Optionally, security bolts (not shown) can be fastened at the ends of each bar 26. An exemplary size of the bars are as follows: 6 in. height×6–10 in. width×3–4 ft. length.

Figure 10:
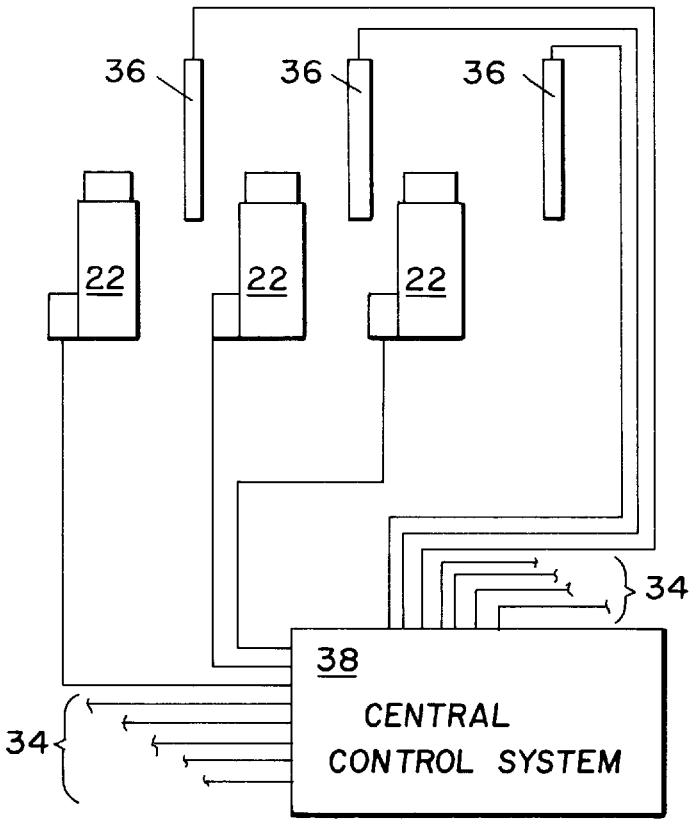
FIG. 10 is schematic diagram of the central construction control system involving the laser height sensors recording and cooperating with the height adjustment of the multiple lifting devices.

The levelling of the floor beam structure before welding or bolting of the joints is conducted by utilizing a vertically oscillating laser device 34 aimed at laser sensors 36, preferably with magnetic bases, selectively positioned on certain metal lifting bars 26 as illustrated in FIG. 1. The central control system 38 is graphically illustrated in FIG. 10 to show the cooperation between the laser sensors 36 and the lifting devices 22 as controlled by the central control system 38 which can be a computer directing the sending of laser signals by the oscillating laser devices 34.

Figure 3:
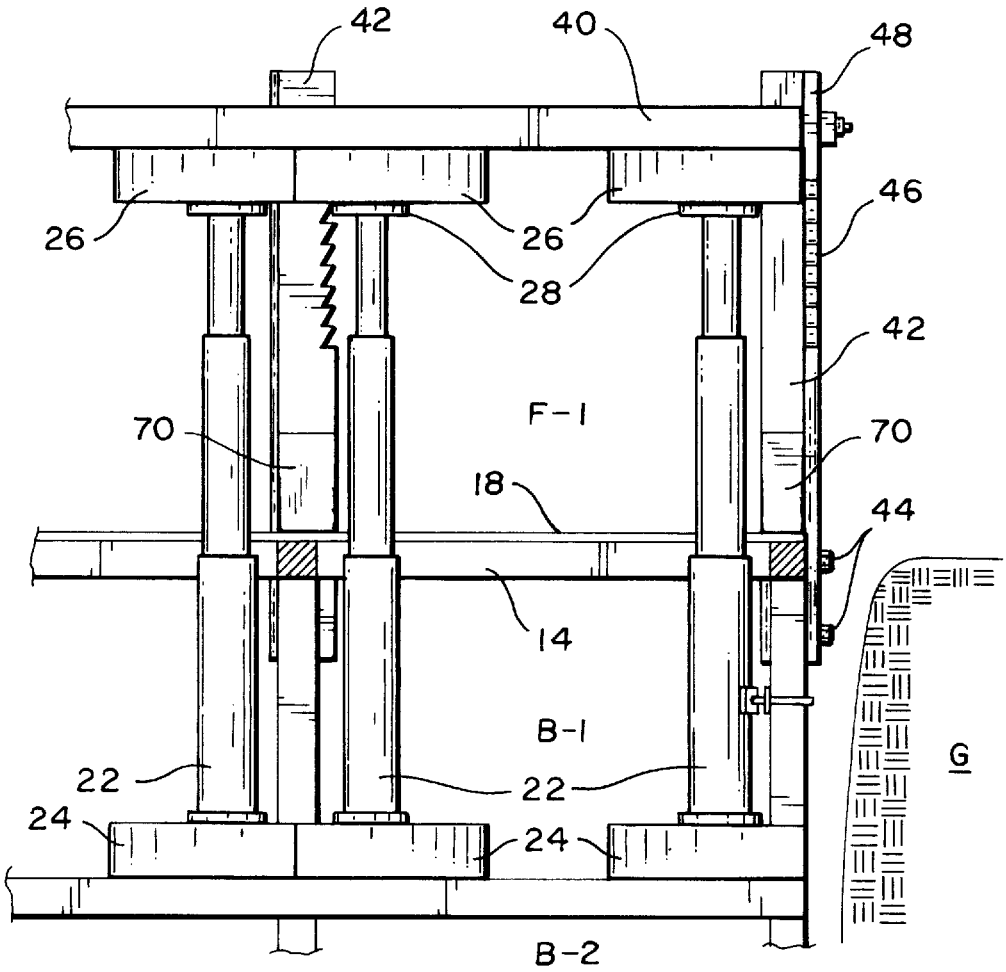
FIG. 3 is a partial front view of a corner section of a horizontal roof beam being lifted.
Figure 4:
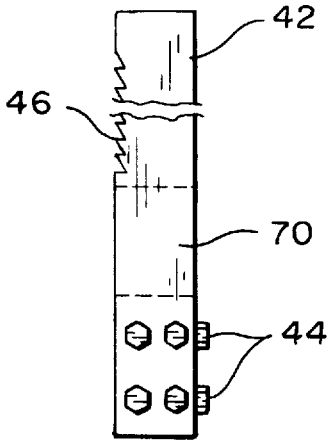
FIG. 4 is a front view of the assembly required for the addition of the next level post prior to the lowering stage of the lifting devices including a short assembling bracket and spacer block arrangement.
Figure 6:
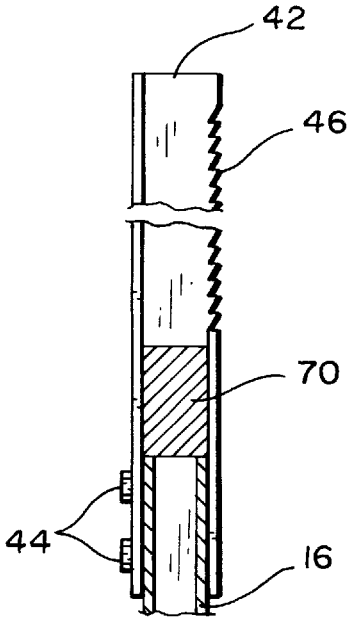
FIG. 6 is a medial cross-section of the FIG. 5 assembly along line 5—5.
Figure 5:
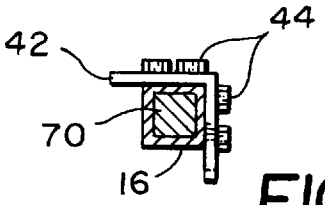
FIG. 5 is a top view of the FIG. 4 assembly.

Once the basement levels B-1 and B-2 are completed and the motorized lifting devices 22 are positioned accordingly, the upper levels will be constructed starting with the roof structure as shown in FIG. 3. The roof beam frame 40 is placed on lifting bars 26 and supported at each post beam location by an assembling bracket 42 which is a 90° angle beam (FIGS. 4–6) secured to the post beam 16 by removable fasteners 44. The upper portion of only one edge of the assembling bracket 42 has a serrated region or teeth 46.

Figure 13:
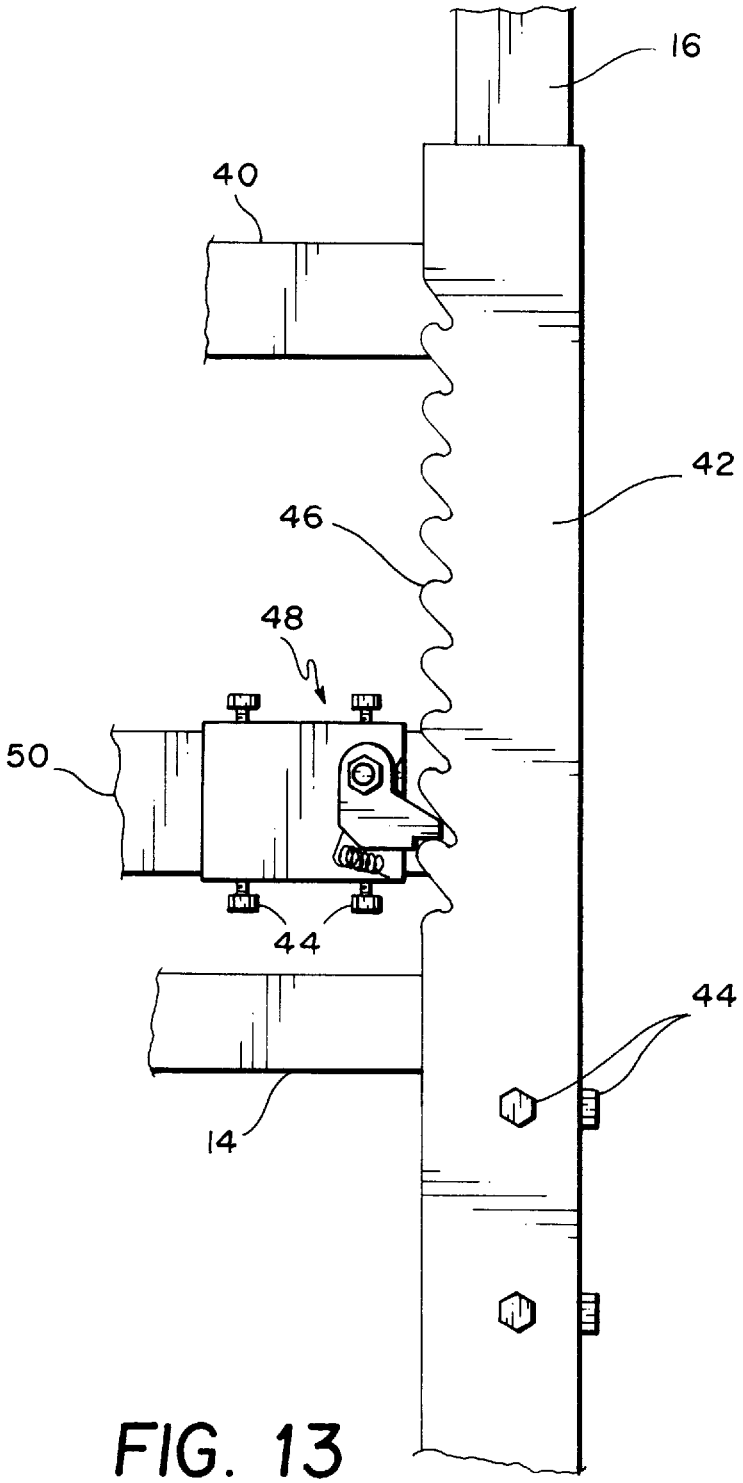
FIG. 13 is a partial side view of a longer assembling bracket and a safety ratchet assembly.
Figure 14:
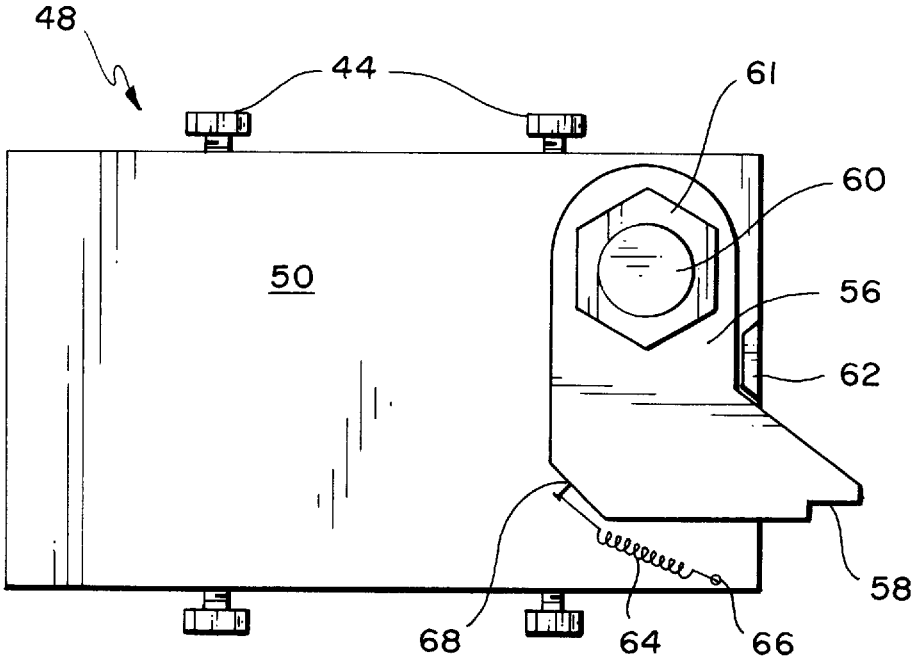
FIG. 14 is a side view of the safety ratchet assembly.
Figure 15:
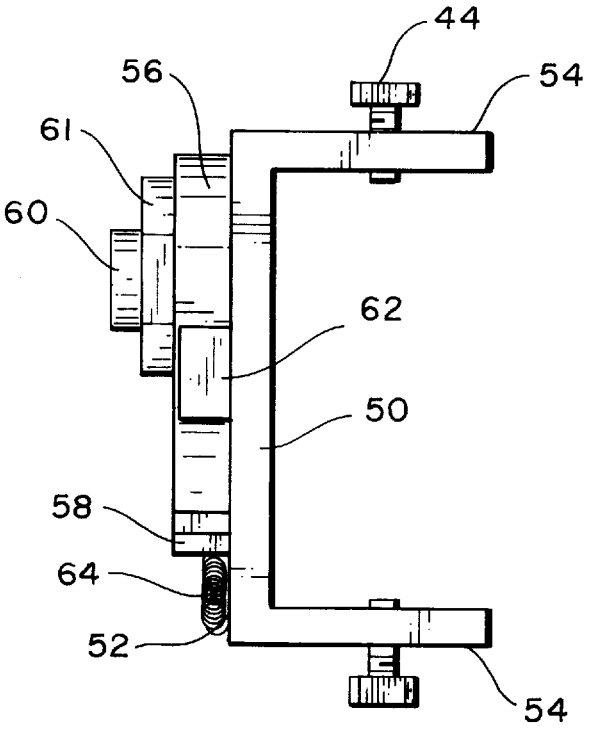
FIG. 15 is a front view of the FIG. 14 assembly.

A ratcheting safety lock assembly 48 is secured to the horizontal beam by fasteners 44 (FIGS. 13–15) as a safety device in the event that the motorized lifting devices 22 fail. The safety lock assembly 48 comprises a U-shaped body 50 having an outside median surface 52 and outside leg surfaces 54. An arm 56 having an indented lip 58 which engages one of the teeth 46 of the installed assembling bracket 42 is attached to the body 50 by a bolt 60 secured by a nut 61 fixed on the arm 56. Consequently, the arm 56 can only rotate upwards to the stop block 62 to prevent the indented lip 58 from exceeding a horizontal level and losing its grip on one of the teeth 46. Return spring 64 is attached to the body 50 at 66 and to the arm 56 at 68 in order to permit the ratcheting safety lock assembly 48 to be elevated along the teeth 46. Therefore, the safety lock assembly 48 and the horizontal beam can be elevated along the assembling bracket 42 by the lifting devices 22 with assurance that the horizontal beam will not fall due to any failure of power to the motorized lifting devices 22.

Figure 7:
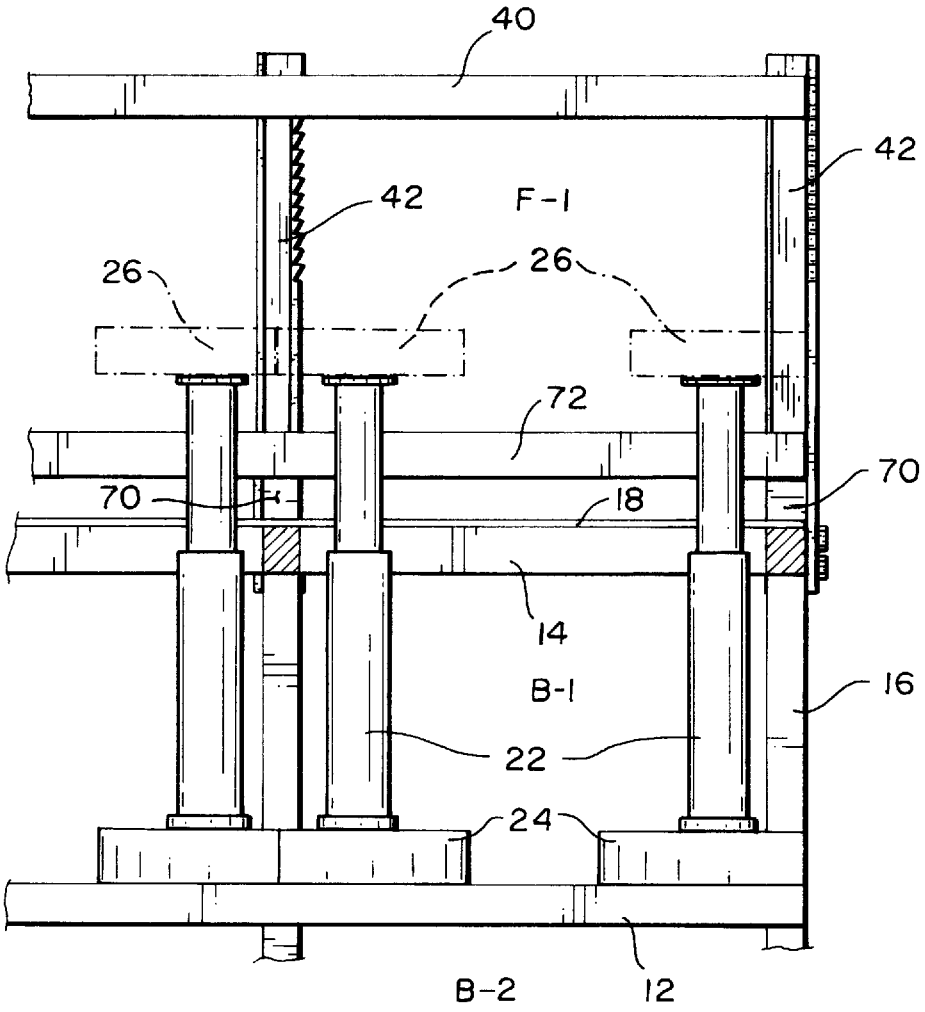
FIG. 7 is a partial front view of the construction illustrating the position of a second floor beam on the spacer blocks after the removal of the lifting bars shown in dashed lines and before the lowering of the lifting devices' heads.
Figure 8:
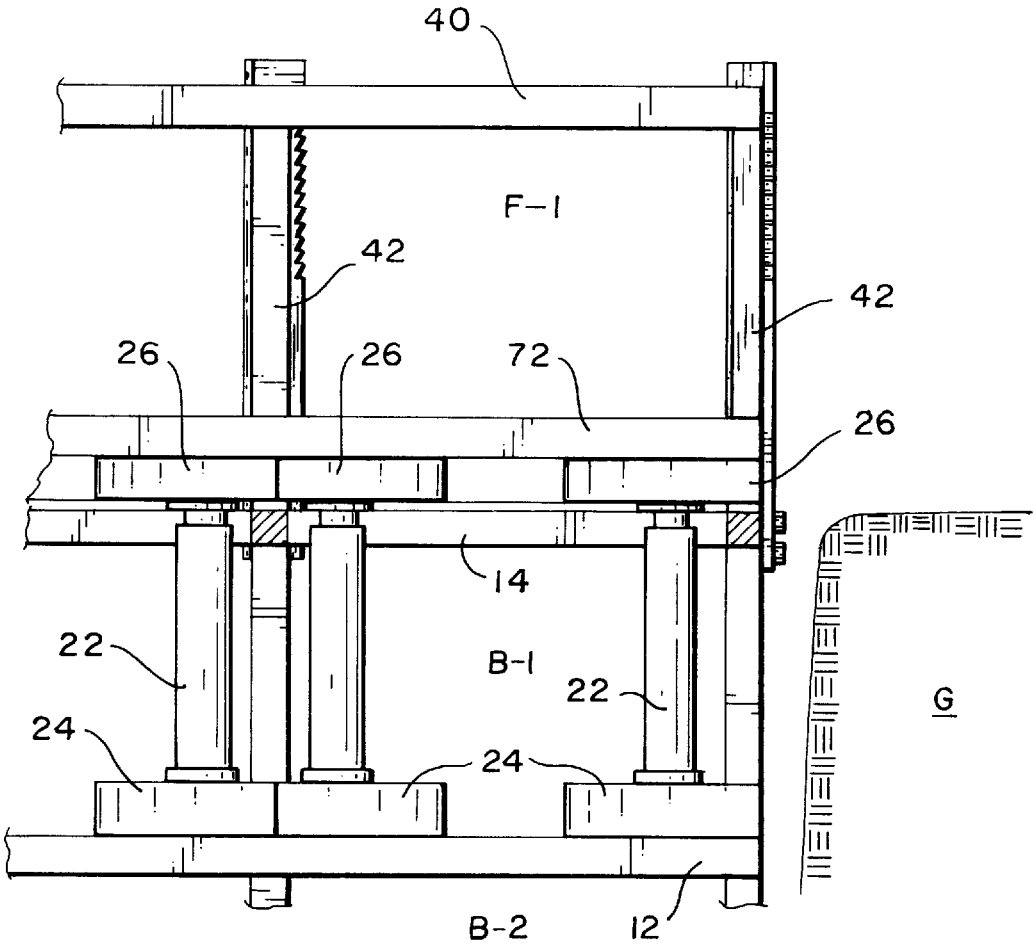
FIG. 8 is a partial front view of the construction showing the lifting bars have been repositioned under a second floor beam and over the lifting devices' heads.
Figure 9:
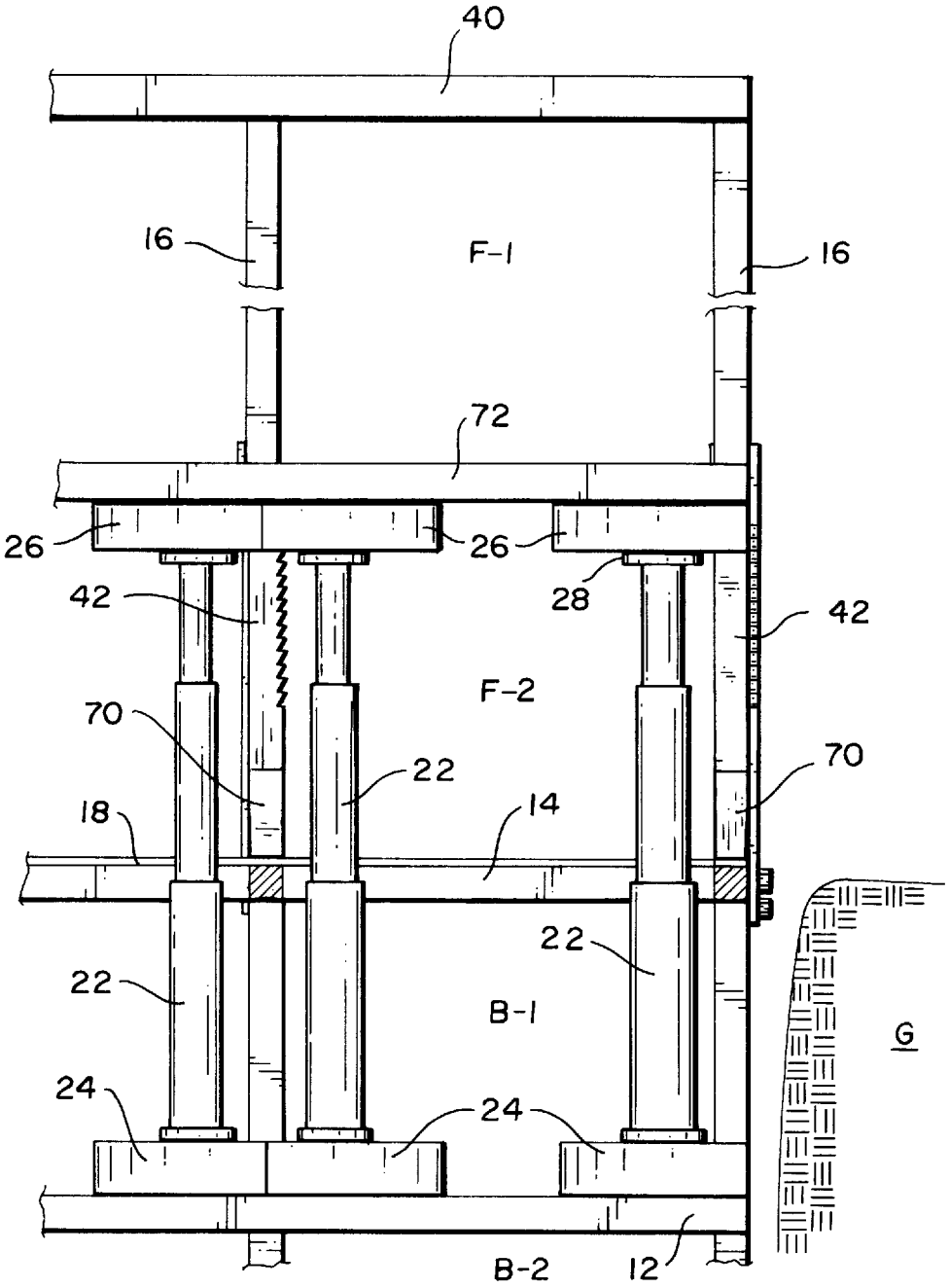
FIG. 9 is a partial front view of the construction illustrating the lifting of the second floor beam framework.

Each assembling bracket 42 contains a metal spacer block 70 which is positioned to abut the floor beam resting on the lower post beam 16. In FIG. 7, the next or the topmost level of floor beams 72 is placed on the spacer blocks 70, and the floor beams 72 are connected such as by welding or bolting. Support plates at the intersections can be added, but are not shown. The purpose of the spacer blocks 70 is to enable the lowering of the lifting device heads 28 with its supported lifting bars 26 (shown in dashed lines in FIG. 7) down to the topmost floor beams 72 for the removal of the lifting bars 26. Then, when the heads 28 of the lifting devices 22 are below the level of the topmost floor beams 72 a sufficient distance, the lifting bars 26 are replaced to abut against the topmost floor beams 72 as depicted in FIG. 8. The motorized lifting devices 22 can now raise the roof structure and the topmost floor region F-1 with the lifting bars 26 to a sufficient height in concert with the ratcheting safety assembly 46 to allow the removal of the spacer block 70 and the insertion of the next series of post beams 16 into the assembling brackets 42 as was done in FIG. 9 for the topmost floor region F-1. F-2 now denotes the next to the topmost floor region formed. The laser measuring and height adjustment procedure of FIG. 10 is again utilized to ensure the horizontal level of the floor constructed before final joining of the beam joints.

Figure 12:
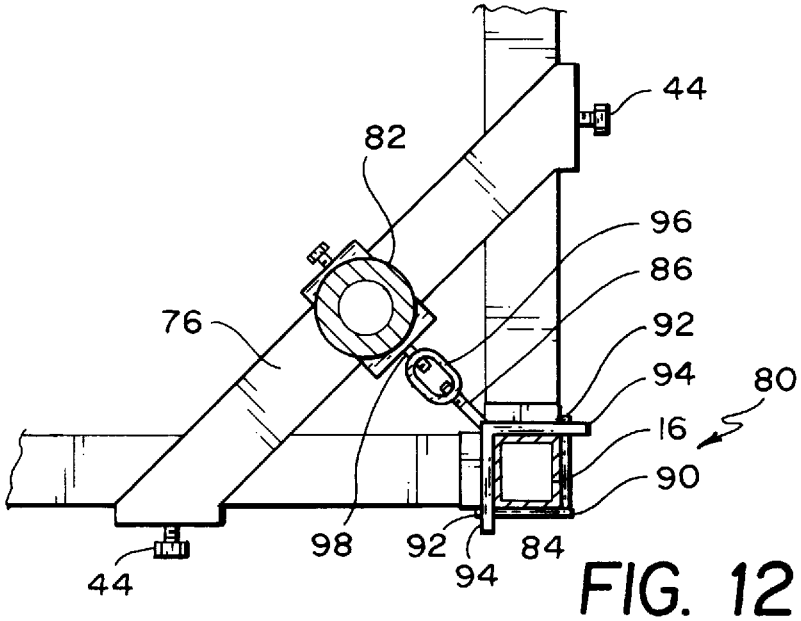
FIG. 12 is a top view of the FIG. 11 apparatus taken through section 12—12.
Figure 11:
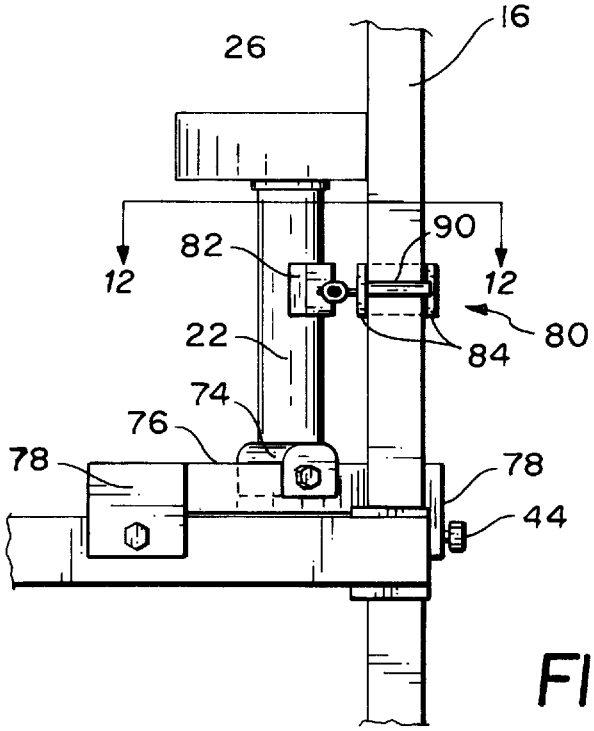
FIG. 11 is a partial perspective view of a corner post structure, wherein a lifting device is stabilized by a post beam clamp and a base clamp on a base support bracket.

Turning to FIGS. 11 and 12, an embodiment directed to the stabilization of a lifting device 22 located in a corner 30 of the building frame is illustrated. A base clamp 74 at the foot of the lifting device 22 is secured by fasteners 44 to a base support bar modified as a base support bracket 76 with flanges 78 which are further secured to the horizontal beams 14 by fasteners 44.

An additional supporting element is a post beam clamp 80 secured on the corner post beam 16 at one end and positioned at the opposite end at a point midway up the lifting device 22 with a concave surfaced block 82. The clamping end consists of a Y-shaped bracket having wide sides 84 which are configured with a right angle, and connected to a straight rod 86 having a threaded end 88. The bracket sides 84 conform to a corner of and are held to a post beam 16, and are secured by a rod 90 with a 90° bend at its center and threaded at both ends. Each threaded end 92 passes through an aperture 94 in each of the wide bracket sides 84, and is further secured by a fastener 44. The threaded end 88 of the rod 86 is connected to a turnbuckle 96 which in turn is threaded on to the post 98 of the concave surfaced block 82. By adjusting the turnbuckle 96, adequate holding tension is applied between the post beam 16 and the lifting device 22.

It should be noted that the base clamp 74 and base support bracket 76 alone or together with the post beam clamp 80 can be utilized for any outside or inside post beams 16 in order to provide additional stability for the lifting devices 22.

After the building is framed, the flooring and walls around the beams can now be completed. This method of building construction is applicable to any type of building structure, whether the structure is made of wood, iron, or steel. In the preferred embodiments shown in the drawing, the structure being raised is a steel or iron frame. The lifting bars 26 allow the motorized lifting devices 22 to support the raised structure while at the same time allowing the motorized lifting devices to be positioned where it will not interfere with the construction of the frame. Once the beamed frame is assembled and attached to the upper levels, the lifting bars 26 and the motorized lifting devices 22 can be repositioned below the beamed frame so that whatever remaining desired construction on that floor can be completed before being raised for the next level.

The spacer blocks 70 and the assembling brackets 42 are essential to the construction of the building, because they will support the newly constructed floor while the frame is being built. Once the frame for a floor level is constructed and the motorized lifting devices 22 are ready to be repositioned, the spacer blocks 70 provide a gap between the working area floor surface and the newly constructed frame to enable the repositioning of the lifting bars 26 below the newly constructed frame.

The second embodiment of FIGS. 16–22 is drawn to the building of wood framed houses. In this embodiment, each elongated lifting bar assembly is connected to the head of each lifting device in a cantilevered fashion by a square metal pin.

Figure 16:
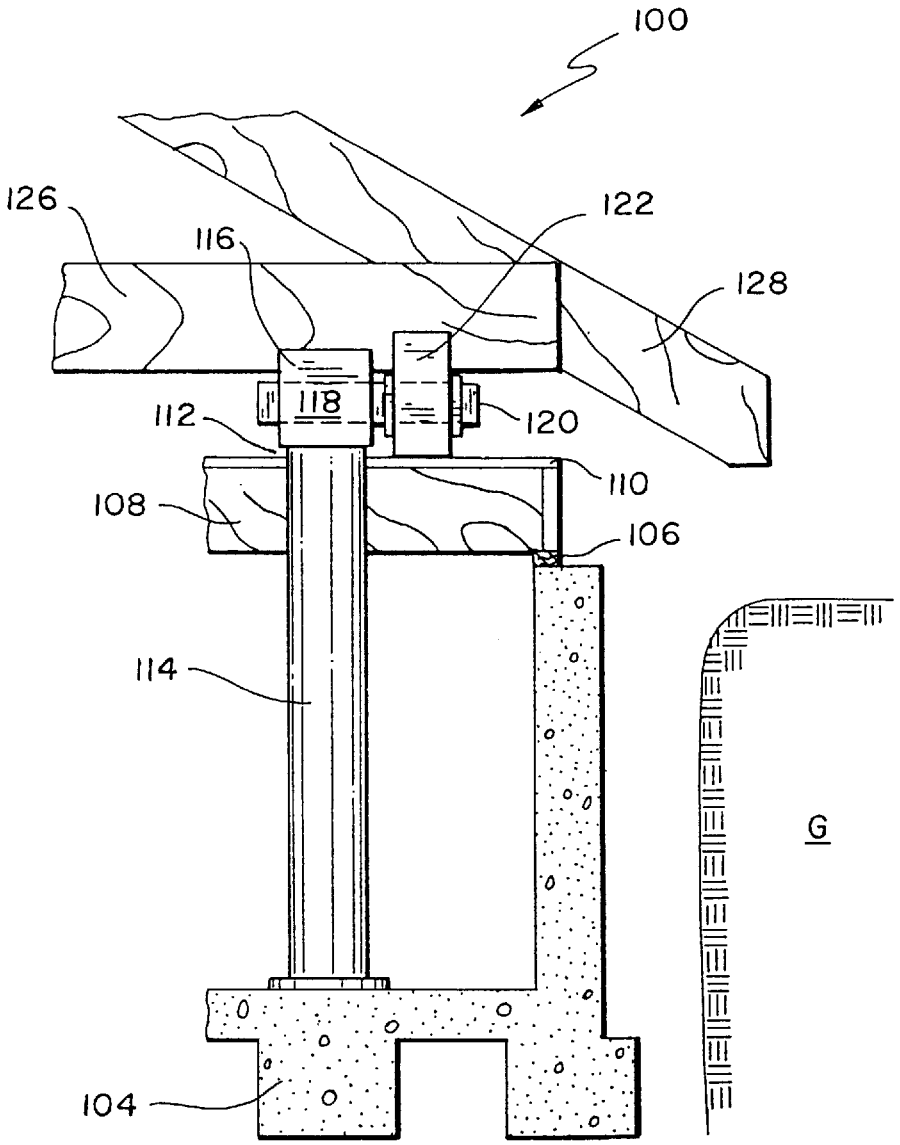
FIG. 16 is a partial front view of the beginning phase of a second embodiment of the present invention for the construction of a wooden framed house.
Figure 18:
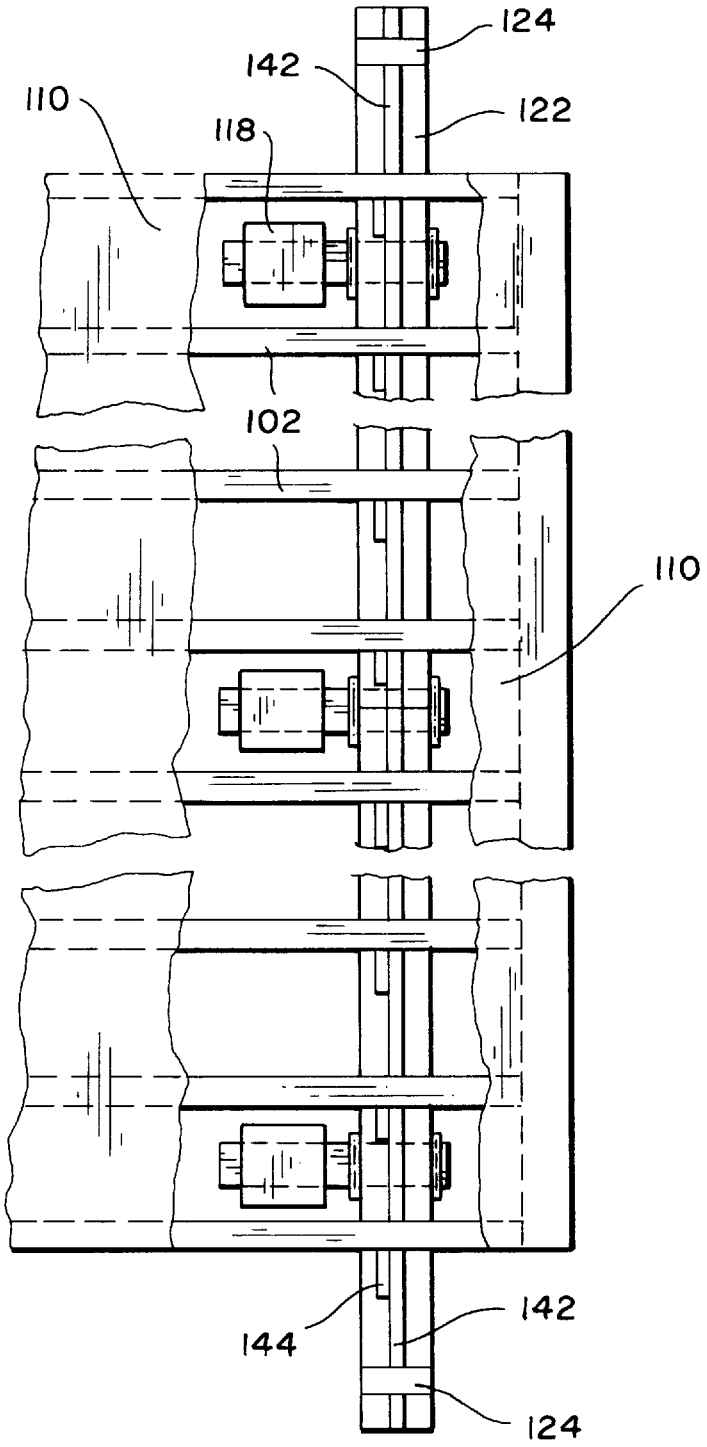
FIG. 18 is a partial top view of the cantilevered lifting bar assembly, lifting devices and a wooden floor frame.

In FIG. 16, the initial stage of building a second floor frame of a wooden framed house 100 from wood joists 102 is illustrated. The concrete foundation 104 is formed first in an excavation of the ground G. Preserved wood planks 106, normally 2 in. by 6 in. in cross-section are placed above the foundation 104 on which must rest on a frame of first floor joists 108. A working surface of wood decking 110 is nailed down temporarily with apertures 112 for the extension of the lifting devices 114. The head 116 of the lifting device 114 has a square bore 118 to insert a steel square pin 120. The pin 120 penetrates a similarly bored first steel lifting bar assembly 122. Thus, the first lifting bar assembly 122 is cantilevered from the head 116 as depicted in FIG. 18, wherein the decking 110 has been partially removed for clarity. The end slots 124 of the first lifting bar assembly 122 are reserved for the possibility that the lifting bar assembly must be shifted one way or the other.

Now, the second floor's ceiling joist frame 126 and the roof rafters 128 for the roof frame are constructed and supported by the lifting devices 114 and the first lifting bar assembly 122.

Figure 17:
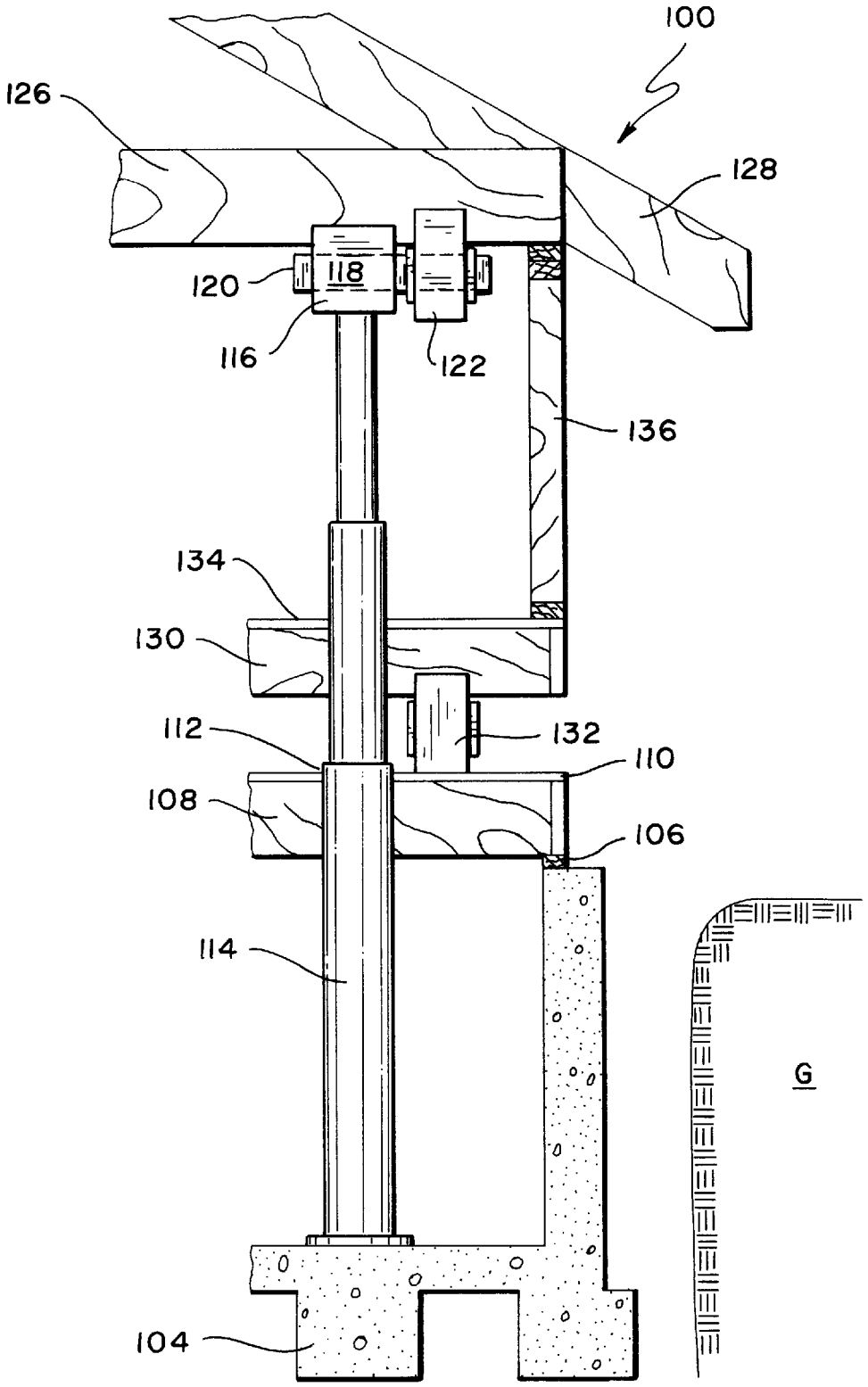
FIG. 17 is a partial front view of the formation of the topmost floor.

Turning to FIG. 17, the lifting device 114 (with all the others) lifts the ceiling joist frame 126 upward slightly to provide clearance for the preparation of the next flooring frame or the second floor frame 130. A series of second lifting bar assemblies 132 are placed on and perpendicular to the first floor frame joists 108 at positions directly under the series of the first lifting bar assemblies 122. Then the second floor frame 130 is built and covered with a temporary decking 134 having apertures 112 for the lifting devices 114. The second floor ceiling joist frame 126 is further lifted to the desired room height to install the wooden wall posts or studs 136. Adjustment of the horizontal alignment of the second floor is made at this time with the aforementioned laser system of FIG. 10. The heads 116 of the series of lifting devices 114 are then lowered to the second floor to remove the first lifting bar assemblies 122 from the heads 116 by removing the square steel pins 120. The heads 116 are lowered still further below the second floor ceiling joist frame 126 and attached to the respective second lifting bar assemblies 132 by the square steel pins 120. The lifting process can be repeated to build another floor for the house 100.

In FIG. 18, the positions of the first lifting bar assembly 122 and the lifting devices 114 are illustrated to show the cantilevered relationship obtained by utilizing square pins 122. End slots 124 are conveniently positioned at the ends as previously explained.

Figure 19:
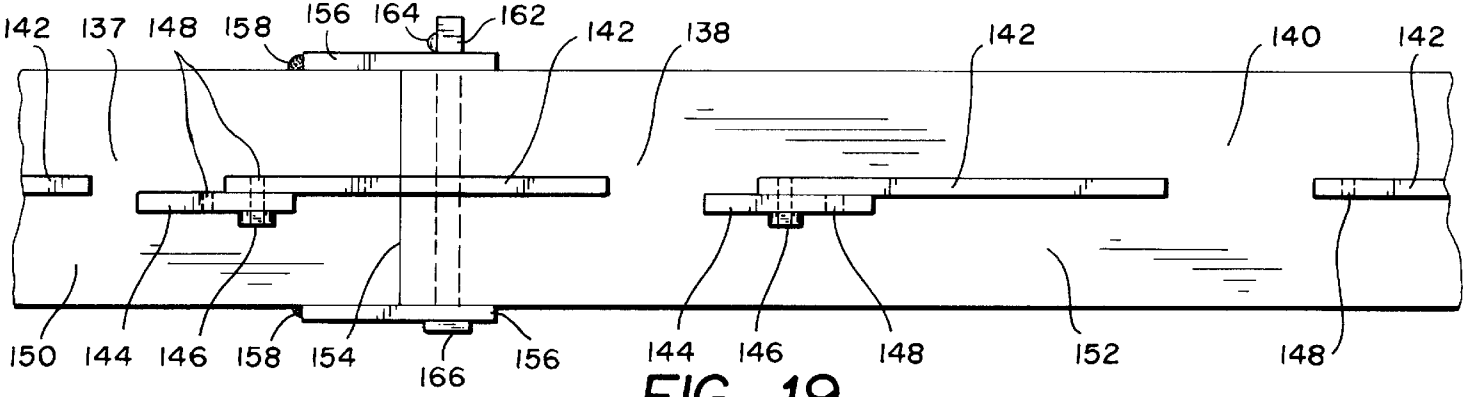
FIG. 19 is a partial top view of the lifting bar providing spaces on top for various thicknesses of joists.

In FIG. 19, the top view of a portion of the metal bar assembly 122 showing three different spaces 137, 138 and 140 provided by the fixed flange 142 and the slidable flange 144 and adjusted by fasteners 146 in either of the bores 148. This fastening arrangement provides for the unique spacing available through the use of only one bore 148 in the fixed flange 142. Two metal bars 150 and 152 are joined at 154 by utilizing metal side plates 156 which are welded at only one edge 158 in order to connect the bars 150 and 152. Two holes 160 are formed in each side plate 156 to accommodate cylindrical metal pins 162 having depressible ball latches 164 at the ends opposite the heads 166. Therefore, the bars 150 and 152 can be readily assembled and disassembled with the use of the pins 162.

Figure 20:
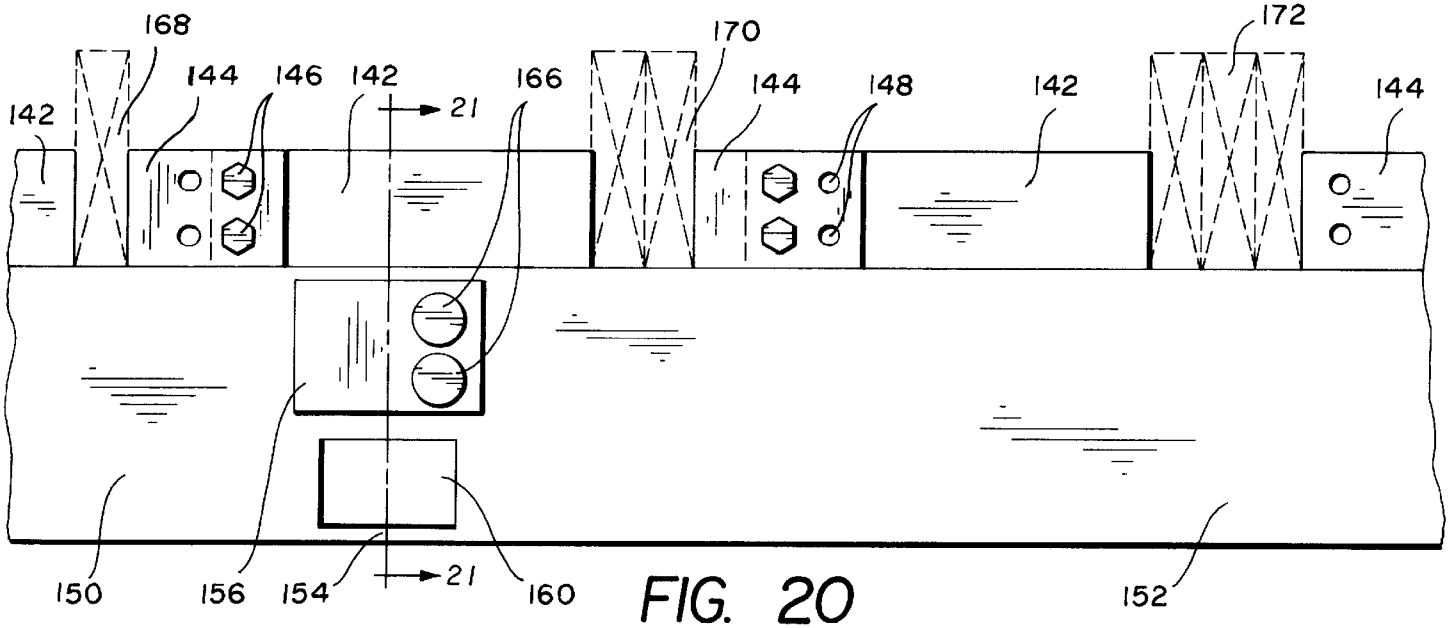
FIG. 20 is a partial side view of the lifting bar of FIG. 19.
Figure 22:
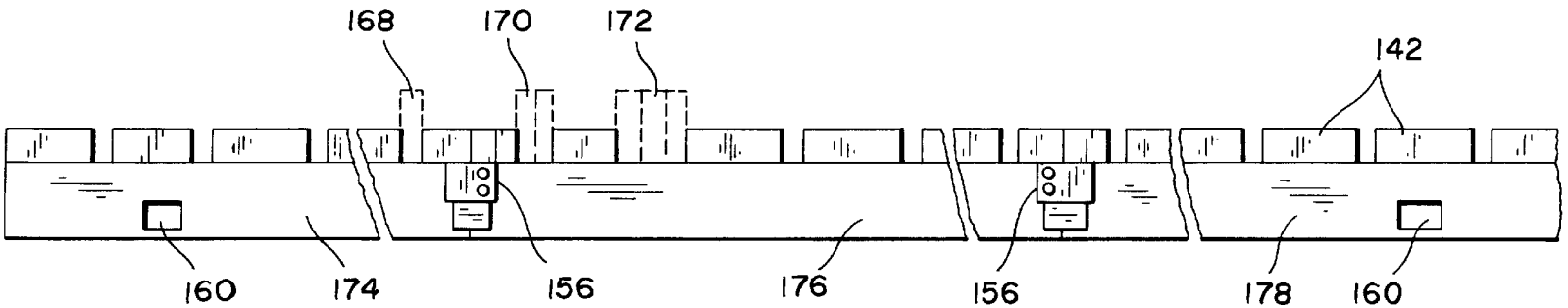
FIG. 22 is a partial side view of a lifting bar assembly wherein three bar units are joined.

FIG. 20 shows the partial side view of the FIG. 19, wherein the spacings 136, 138 and 140 provide for a single joist 168, doubled joist 170 and a tripled joist 172, respectively, which are shown in phantom lines. Underneath the metal side plate 156, a square bore 118 is formed in this situation at the intersection or joint 154 between bars 150 and 152. However, the square bore 118 can be located at a non-joint as best seen in FIG. 22. The square bores 118 utilized for lifting are spaced equidistantly. The lifting bars 150 and 152 can be of unequal lengths.

Figure 21:
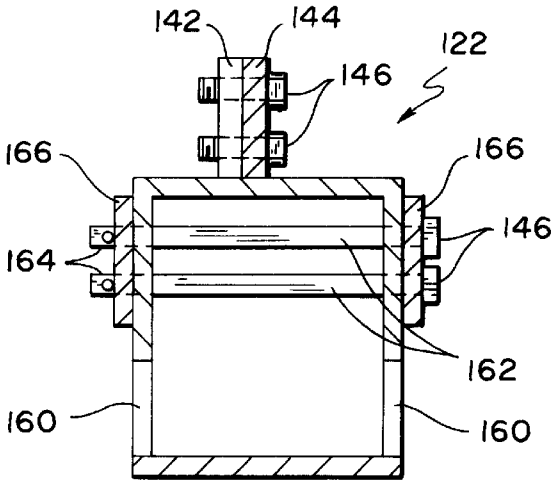
FIG. 21 is a cross-sectional view along line 20—20 of FIG. 20.

FIG. 21 is a cross-sectional view along the line 21—21 of FIG. 20. The two metal pins 162 are shown secured by the depressible ball latches 164. The slidable flange 144 is secured to the fixed flange 142 by two fasteners 146.

FIG. 22 illustrates the joining of three separate bars 174, 176 and 178 to form the either the first lifting bar assembly 122 or the second lifting bar assembly 132. The joists 168, 170 and 172 are shown in shadow lines in exemplary positions.

This unique cantilevered mode of operation is possible for building wooden framed houses because of the difference in weight between steel beamed framing and wooden framing.

Figure 23:
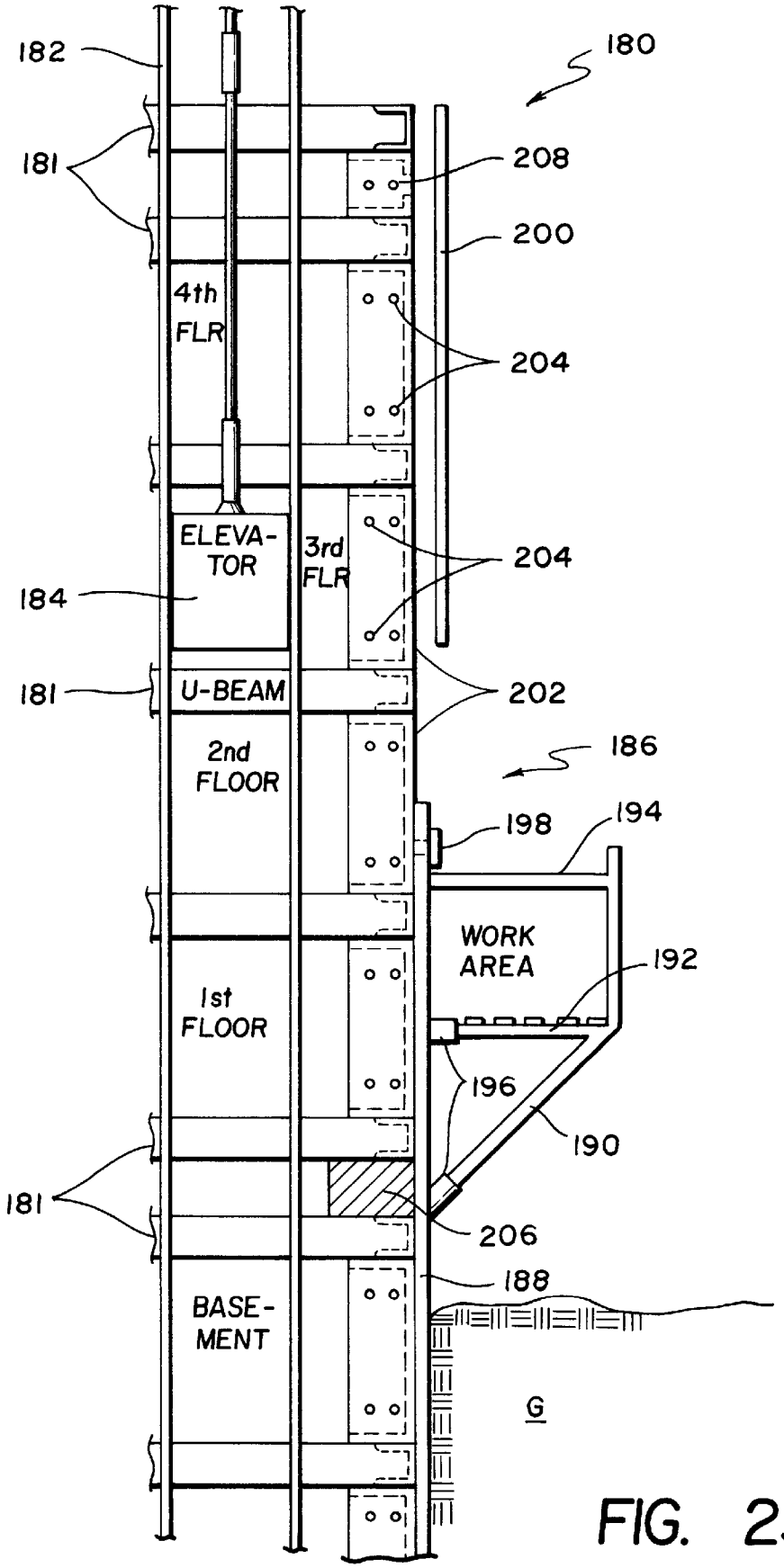
FIG. 23 is a side view of a four story building frame having apertured corner posts for the placement of outside glass panes (isolated) and the workstation for the lower floors.
Figure 24:
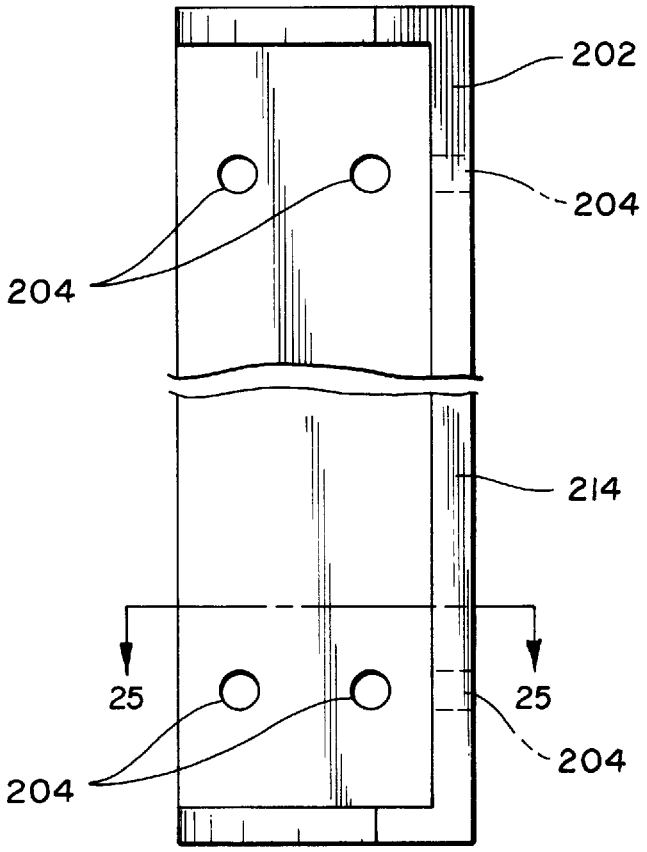
FIG. 24 is a side view on an apertured corner post of FIG. 23.
Figure 25:
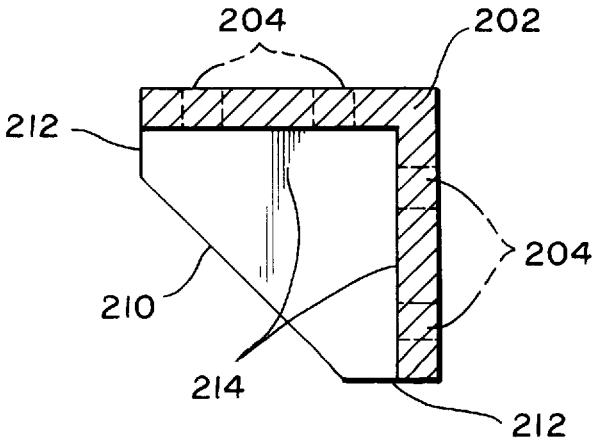
FIG. 25 is a sectional view along the line 25—25 of the corner post of FIG. 24.

In FIGS. 23–25, a modification in the building of steel frame buildings having a glass facade is illustrated. A steel building 180 with four floors and at least one basement level with U-beams 181 as floor framing is built by the present invention as depicted in FIG. 23. An elevator shaft 182 with an elevator 184 has been installed. A workstation 186 has been implanted next to one side of the building 180 in the ground G. The side view of the workstation 186 shows two main posts 188 (only one visible) with two inclined posts 190 (only one shown) supporting the flooring 192 and guard rails 194. The inclined posts 190 and the flooring 192 are supported at the main posts 188 by sleeves 196, whereas the quard rails 194 are bolted to the main posts. The workstation 186 can be as high as one-half of the building being constructed, but only 6–10 feet wide, since it can be moved. A side support bar 198 is attached to the innovative corner posts 200 and any intermediate posts (not shown) from one corner of the building 180 to the opposite corner. The inter-mediate posts can be posts 16 as in FIG. 2. The side support bar 198 thus pins the workstation 186 to the building 180 at the uppermost level of the workstation.

A glass facade pane or panel 200 is shown separated from the building 180 in FIG. 23 for illustrative purposes, but will be fastened to the corner posts 202 and any intermediate post by the four holes 204 in each of two sides shown in FIGS. 23 and 24.

In FIG. 23, a block 206 is depicted between the horizontal beams of the basement and the first floor regions. This block is used to support the hydraulic jacks 22 of FIG. 2. The shortened corner post 208 below the top beam is similar in construction to the corner posts 202 shown between floors.

FIG. 24 illustrates a corner post 202 with eight holes 204 (two holes hidden) which is suitable for any corner of the building frame.

However, FIG. 25 indicates that the top (not shown) and bottom flanges 208 have an exposed three-sided edge with one long straight edge 210 between short straight edges 212. The reason for this configuration is to provide an increase in the structural support for the vertical flanges 214 of the corner post 202.

Thus, the present invention provides unique methods of construction for a multi-level building, whether framed with wood or steel beams, from the ground up by forming the roof frame first with different apparatus such as hydraulic jacks and a laser measuring system integrated with a central computerized system. Also integrated with this construction system are lifting bars, temporary assembly brackets, clamps, safety ratchet assemblies, distinctive apertured corner posts, and a combination building support and working area assembly.

It is to be understood that the present invention is not limited to the embodiments described above, but encompasses any and all embodiments within the scope of the following claims.

I claim:

1. A construction apparatus system for constructing a building frame from the bottom comprising:

a plurality of motorized lifting devices;

a temporary horizontal working floor frame with horizontal intersecting beams;

a plurality of solid lifting bar assemblies;

a roof frame with intersecting wall beams aligned with said intersecting beams of the temporary horizontal working floor frame;

a plurality of vertical post beams at each intersection of the horizontal intersecting beams of the temporary working floor frame;

a laser system including a laser device and laser sensors: and a computerized control system; whereby each lifting bar assembly is positioned over each motorized lifting device to lift the roof frame to a higher horizontal level in a coordinated manner by laser sensors on selected lifting bar assemblies and a laser device cooperating with the computerized control system for positioning of each vertical post beam at each intersection of the roof frame, and the assembly of each successive floor frame is repeated to complete the building frame from the ground level.

2. The construction apparatus system according to claim 1, wherein the motorized lifting devices are selected from hydraulic jacks and pneumatic jacks.

3. The construction apparatus system according to claim 1, wherein the motorized lifting devices are hydraulic jacks.

4. The construction apparatus system according to claim 1, wherein the motorized lifting devices are pneumatic jacks.

5. The construction apparatus system according to claim 1, wherein the building frame is metal and the horizontal working floor frame is removable for removal after an upper floor frame is installed.

6. The construction apparatus system according to claim 5, including a horizontal metal roof beam frame having intersecting horizontal metal wall beams for positioning over at least one metal lifting bar of the lifting bar assembly at a metal post beam at each intersection;

a metal assembly bracket for attaching to each metal post beam, having a right-angle configuration and confining a metal spacer block resting on each said metal post beam;

said metal assembly bracket containing a serrated edge in an upper region; and a ratchetable metal safety lock assembly for securing each end and each intersection of a horizontal metal floor beam frame, whereby each ratchetable safety lock assembly engaging said serrated edge of the cooperating assembly bracket to secure together the horizontal metal roof beam frame and the horizontal metal floor beam frame;

whereby said motorized lifting devices elevate a metal roof beam frame to a uniform horizontal height for placement of a metal post beam at each intersection by cooperation of each ratchetable metal safety lock assembly, laser sensor devices, the laser device, the motorized lifting devices, and the central computerized control system.

7. A construction apparatus system according to claim 6, wherein the straight metal lifting bars of the same shape form configurations as a square with a square aperture, a V-shape and a straight bar on an open horizontal floor beam frame; and the square configuration resting on intersecting horizontal metal wall beams around a metal post beam, the V-shape configuration resting on a horizontal outside metal wall beam to straddle a T-intersection over a metal post beam, and the straight bar straddling horizontal metal corner beams adjacent to a metal corner post beam.

8. The construction apparatus according to claim 1, wherein the metal beam posts include metal corner posts having a set of four predetermined apertures for the placement of glass panels for a glass facade building.

9. The construction apparatus according to claim 8, wherein a removable workstation supported by two main posts is implanted in the ground abutting the framed building, and a side support bar fastened to a side of the framed building to support the upper portion of the removable workstation.

10. The construction apparatus system according to claim 1 for constructing a wooden building frame from the bottom comprising:

a horizontal wooden working first floor joist frame with intersecting joists positioned on a concrete foundation;

motorized lifting devices positioned adjacent to the first floor joists;

a series of first metal lifting bar assemblies longer in length than the wooden first floor joist frame in a perpendicular position;

each lifting device having a head apertured to support a pin which supports a first lifting bar assembly;

a series of second metal lifting bar assemblies which support a second floor joist frame; and each first and second lifting bar assembly has adjustable separators on top to accommodate at least one joist; whereby the wooden frame house can be built from the ground up by utilizing the first and second lifting bar assemblies to lift the wooden first floor joist frame with a series of motorized lifting devices which are positioned adjacent to the first and second lifting bar assemblies.

11. The construction apparatus according to claim 10, wherein the series of motorized lifting devices are selected from hydraulic jacks and pneumatic jacks which lift the wooden first floor joist frame simultaneously in response to the central computerized control system.

12. The construction apparatus system according to claim 1, wherein the motorized lifting devices are hydraulic jacks.

13. The construction apparatus system according to claim 1, wherein the motorized lifting devices are pneumatic jacks.

14. The construction apparatus according to claim 1, wherein the laser system comprising laser sensor devices positioned on selected metal lifting bars and responsive to a laser device controlled by the central computerized control system; whereby said motorized lifting devices elevate a metal roof beam frame to a uniform horizontal height for placement of second metal beam posts at each intersection by cooperation of the laser sensor devices, the laser device, the motorized lifting devices, and the central computerized control system.

15. A method of constructing a building frame from the ground up comprising:

providing a plurality of motorized lifting devices;

providing a horizontal working floor frame with intersecting beams;

providing a plurality of solid lifting bar assemblies;

providing a roof frame with intersecting wall beams aligned with said intersecting beams of the temporary horizontal working floor frame;

providing a plurality of vertical post beams at each intersection of the horizontal intersecting beams of the temporary working floor frame;

providing a laser system including a laser device and laser sensors:

providing a computerized control system;

positioning each lifting bar assembly over each motorized lifting device to lift the roof frame to a higher horizontal level in a coordinated manner in response to laser sensors on selected lifting bar assemblies receiving laser impulses from a laser device cooperating with the computerized control system; and the assembly of each successive floor frame is repeated to complete the building frame from the ground level.

16. The construction method according to claim 15, wherein the motorized lifting devices are selected from hydraulic jacks and pneumatic jacks.

17. The construction method according to claim 16 for building a metal building comprising:

providing straight metal lifting bars of the same shape to form configurations as a square with a square aperture, a V-shape and a straight bar on an open horizontal first floor beam frame;

resting the square configuration on intersecting horizontal metal wall beams around a metal post beam, resting the V-shape configuration a horizontal outside metal wall beam to straddle a T-intersection over a metal post beam, and resting the straight bar to straddle metal corner beams over a metal corner post beam;

positioning a motorized lifting device under each lifting bar;

securing a temporary metal assembly bracket on each post beam having an upper toothed region and a confined spacer block, and attaching a ratcheting safety lock assembly on the roof beam frame adjacent to each assembly bracket;

elevating said roof beam frame by extending the motorized lifting devices and controlling the elevation by a central computerized control system until each ratcheting safety lock assembly engages the upper toothed region of each assembly bracket;

adjusting the horizontal elevation of the roof beam frame at specific points by the central computerized control system which includes laser sensors attached to selected lifting bars and responsive to an emitting laser to adjust the uniform height of the roof beam;

removing each spacer block and inserting therefore a metal post beam which is connected to the roof beam frame at its upper end; and repeating the construction process for each successive floor beam frame until the metal building frame is completed.

18. The construction method according to claim 17, including implanting a removable workstation in the ground abutting the framed building; and fastening a side support bar to a side of the framed building to support the upper portion of the removable workstation.

19. The construction method according to claim 16 for building a wooden building comprising:

forming and positioning a horizontal wooden first floor joist frame on a concrete foundation;

positioning a series of motorized lifting devices adjacent to the first floor joists;

placing a series of first metal lifting bar assemblies longer in length than the wooden first floor joist frame in a perpendicular position to the first floor joist frame;

each lifting device having a head apertured to support a pin which supports a first lifting bar assembly;

supporting a second floor joist frame in a perpendicular position by a series of second metal lifting bar assemblies; and placing adjustable separators on top of each first and second lifting bar assembly to accommodate at least one joist;

lifting the wooden first floor joist frame with the series of motorized lifting devices with heads which are positioned adjacent to the first and second lifting bar assemblies; and repeating the process for each successive floor.

20. The construction method according to claim 19, wherein the series of first and second metal lifting bar assemblies are connected to the heads of the motorized lifting devices by a cantilevered square pin.

* * * * *